US007587871B2

(12) United States Patent
Perry

(10) Patent No.: US 7,587,871 B2
(45) Date of Patent: Sep. 15, 2009

(54) SIMULATED HAND LAID BRICK AND MORTAR WALL COVERING

(75) Inventor: John Elliott Perry, Dania, FL (US)

(73) Assignee: Exteria Building Products, Miami, FL (US)

( * ) Notice: Subject to any disclaimer, the term of this patent is extended or adjusted under 35 U.S.C. 154(b) by 318 days.

(21) Appl. No.: 11/068,993

(22) Filed: Feb. 28, 2005

(65) Prior Publication Data

US 2006/0191228 A1 Aug. 31, 2006

(51) Int. Cl.
*E04D 1/00* (2006.01)
*E04D 1/34* (2006.01)

(52) U.S. Cl. ..... 52/539; 52/536; 52/544; 52/555

(58) Field of Classification Search ..... 52/539, 52/536, 554, 555, 544
See application file for complete search history.

(56) References Cited

U.S. PATENT DOCUMENTS

| | | | | | |
|---|---|---|---|---|---|
| 1,931,709 | A | * | 10/1933 | Schaffert | 52/314 |
| 2,021,578 | A | * | 11/1935 | Odell | 52/314 |
| 2,110,485 | A | * | 3/1938 | Hunt | 52/471 |
| 2,200,649 | A | * | 5/1940 | Wardle | 52/489.2 |
| 2,209,283 | A | * | 7/1940 | Ronzone | 52/314 |
| 3,613,326 | A | | 10/1971 | Mollman | |
| 3,621,625 | A | * | 11/1971 | Medow | 52/314 |
| 3,646,715 | A | * | 3/1972 | Pope | 52/309.9 |
| 3,908,326 | A | * | 9/1975 | Francis | 52/384 |
| 3,968,610 | A | * | 7/1976 | Medow | 52/314 |
| 4,223,490 | A | * | 9/1980 | Medow | 52/98 |
| 4,241,554 | A | * | 12/1980 | Infantino | 52/314 |
| 4,327,528 | A | * | 5/1982 | Fritz | 52/309.1 |
| 4,522,002 | A | * | 6/1985 | Davis et al. | 52/309.1 |
| 4,589,241 | A | * | 5/1986 | Volpenhein | 52/315 |
| 6,170,215 | B1 | * | 1/2001 | Nasi | 52/521 |
| 6,240,691 | B1 | * | 6/2001 | Holzkaemper et al. | 52/315 |

* cited by examiner

*Primary Examiner*—Richard E Chilcot, Jr.
*Assistant Examiner*—Andrew J Triggs
(74) *Attorney, Agent, or Firm*—Leydig, Voit & Mayer, Ltd.

(57) ABSTRACT

A wall covering comprised of a plurality of panels formed with a simulated hand laid brick and mortar design. The panels are mounted in horizontal courses with a lower marginal edge region of one panel being in overlying relation to the upper marginal edge region of a panel in a previously mounted course. The upper and lower marginal edge regions have a tapered seating design which enable close positioning of the brick and mortar of two mating panels with the mortar lines between the brick being in substantially coplanar relation with each other and with the simulated brick each protruding a uniform distance from the mortar lines with an esthetic and natural appearance. The junction between mating panels is substantially unnoticeable and the uniformity of the brick and mortar design does not incur unsightly shadowing that can detract from the natural appearance.

12 Claims, 4 Drawing Sheets

10
11b
11a
11
15
18
19
20
21
22
23
24
25
26
27
28
30
33

SIMULATED HAND LAID BRICK AND MORTAR WALL COVERING

FIELD OF THE INVENTION

The present invention relates generally to wall and roof coverings primarily intended for outdoor usage, and more particularly, to wall coverings comprised of relatively large panels which each are molded or otherwise formed with a brick and mortar pattern characteristic of a conventional hand-laid brick wall.

BACKGROUND OF THE INVENTION

Various synthetic roof and wall coverings are known today, such as those formed of elongated thermoplastic wall panels that are nailed or screwed to a wall or support surface in horizontal courses or rows in partially overlapping relation to each other so as to provide a substantially water resistant, protective layer over the support surface. Such panels, which usually are identically molded, commonly are formed with a plurality of horizontal rows of simulated building elements, such as brick, shake shingles, tile and the like. Since the panels are identically molded, a panel-to-panel identity can be easily noticed if the panels are not carefully installed, which can be tedious and time consuming.

Concealing the panel-to-panel identity of panels formed with brick and mortar patterns has been particularly difficult since the exposed faces of the brick of adjacent panels must be substantially in the same plane. Because lower marginal edge region of one panel typically is mounted in partially overlapping relation to the upper marginal edge region of a panel in an underlying row or course, there commonly is a step down in the mortar line from the top panel to the lower panel and to maintain the coplanar relation of the exposed faces of simulated brick, the simulated brick in the top row of the underlying panel has a greater exposed depth from the mortar line, as compared to the bricks of the other rows on the panel. While the additional thickness or depth of the upper row of brick can itself detract from the esthetic appearance of the wall installation, under certain lighting conditions, a dark shadow line also can occur between adjacent rows of brick on the top and bottom panels that does not exist between other rows of brick on the panel, further accentuating the line of demarcation between the panels and detracting from the natural appearance of the simulated brick wall. Temperature expansion and contraction of the panels can further increase the juncture line between the brick and mortar of adjacent top and bottom panels.

OBJECTS AND SUMMARY OF THE INVENTION

It is an object of the present invention to provide a wall covering comprised of panels formed with simulated hand-laid brick and mortar designs that can be installed with a more esthetic and natural appearance.

Another object is to provide a wall covering as characterized above in which the exposed faces of both the simulated brick and the mortar lines of adjacent panels are in substantially coplanar relation to each other, typical of a natural hand-laid brick and mortar wall.

A further object is to provide a wall covering of the above kind in which the juncture between the brick and mortar of a bottom row of brick of one panel and the top row of brick of an overlying panel is substantially unnoticeable.

Yet another object is to provide a wall covering of the foregoing type in which temperature expansion and contraction of the panels does not materially detract from the esthetic appearance of the juncture between the rows of simulated brick and mortar of one panel and an underlying panel.

Still another object is to provide a wall panel for use in a wall covering of the foregoing type which lends itself to efficient insulation.

Other objects and advantages of the invention will become apparent upon reading the following detailed description and upon reference to the drawings, in which:

Figures 1, 3:
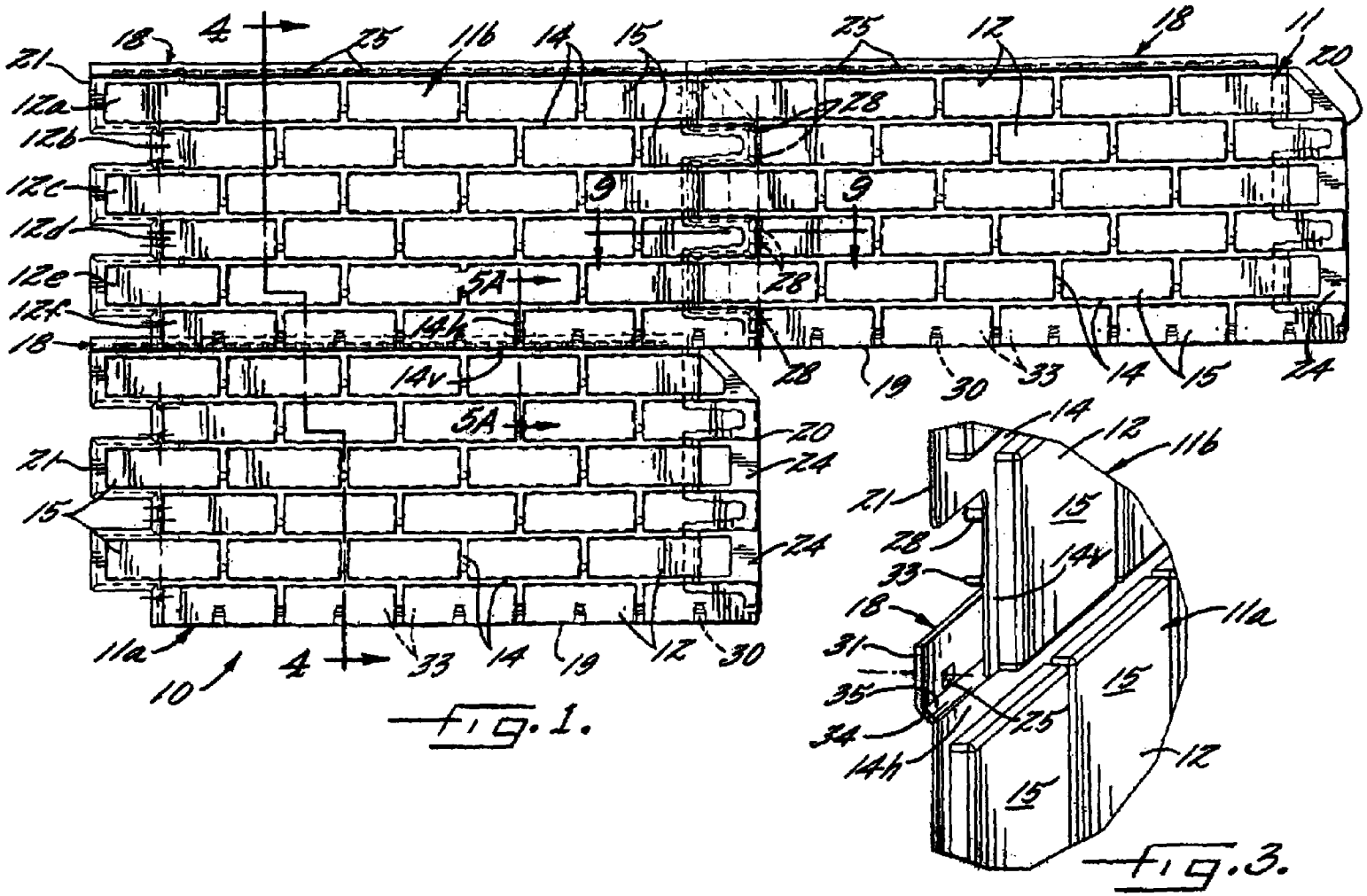
FIG. 1 is a side elevational view of a wall covering having panels formed with a hand-laid brick and mortar design in accordance with the invention.
FIG. 3 is an enlarged perspective of the mating horizontal junction between the illustrated panels, taken and the encircled area of FIG. 2.
Figure 2:
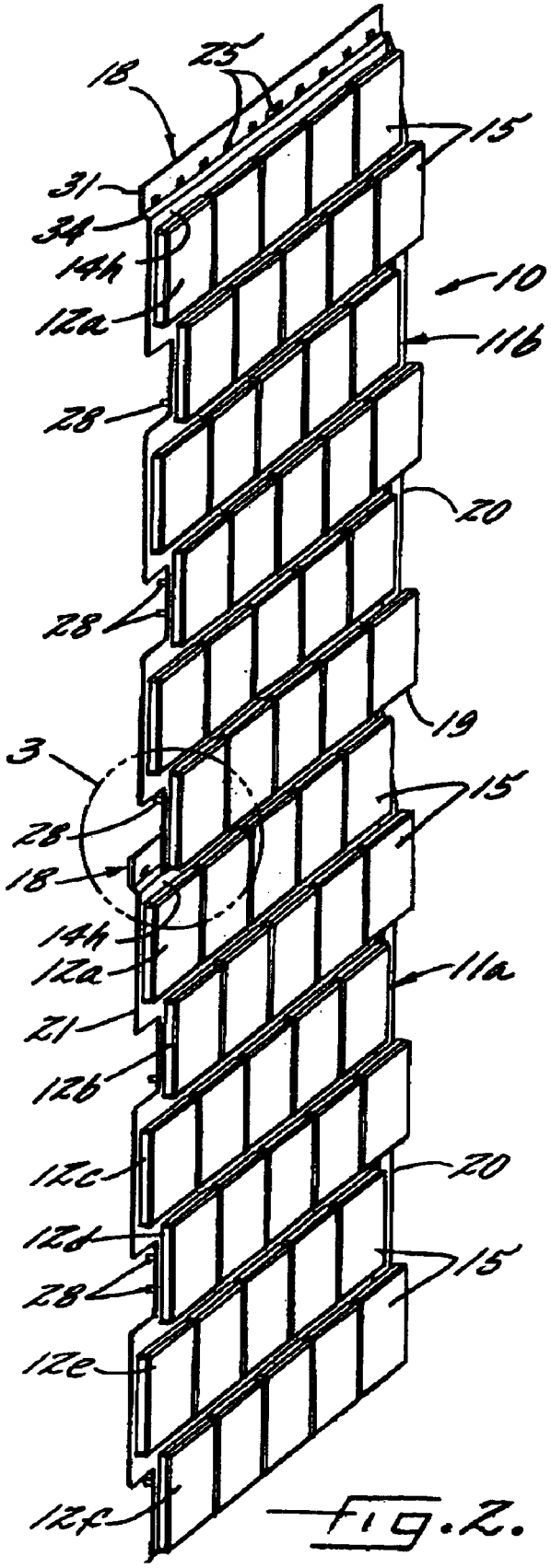
FIG. 2 is a perspective of partially overlapping top and bottom panels in two of the courses of the illustrated wall covering.

While the invention is susceptible of various modifications and alternative constructions, a certain illustrated embodiment thereof has been shown in the drawings and will be described below in detail. It should be understood, however, that there is no intention to limit the invention to the specific form disclosed, but on the contrary, the intention is to cover all modifications, alternative constructions and equivalents falling within the spirit and scope of the invention.

DETAILED DESCRIPTION OF PREFERRED EMBODIMENT

Referring now more particularly to the drawings, there is shown an illustrative wall covering 10 comprising a plurality of panels 11 in accordance with the invention. The panels 11, which preferably are molded of thermoplastic material, are formed with a simulated brick and mortar design, typical of hand-laid bricks. Simulated bricks 12 in this case are disposed in a plurality of parallel horizontal rows 12*a*-12*f* with the bricks 12 each being isolated from each other by lines of mortar 14. The bricks 12 protrude outwardly of the mortar lines 14, typical of hand-laid brick, with outer exposed faces 15 of the bricks being in substantially the same plane. It will be understood that the panels could be formed with other brick arrangements or with other forms of simulated building elements.

Each panel 11 has an upper horizontal marginal edge region 18 having a substantially uniform width extending across the top of the panel immediately above the top row 12*a* of brick 12, a lower marginal edge region 19 which defines a lower peripheral edge of the panel, a side marginal edge region 20 located to the right-hand side of the last simulated brick 12 in each row 12*a*-12*f*, and a left side marginal edge region 21 on the opposite side of the panel 11. The panels 11 are mounted on a support surface 22, which may be a wall of a house or other building structure, in horizontal courses with the right-side marginal edge region 20 in underlying relation to the left-side marginal edge region 21 of the panel immediately to the right thereof and with the lower marginal edge region 19 of the panels in each course overlying the upper marginal edge region 18 of the panel in a previously installed course immediately below.

To enable mounting of the panels 11 in side-by-side relation with the junctures between adjacent panels less noticeable to the eye, the alternate rows of brick 12 of each panel 11 extend in offset relation to each other so as to define staggered left and right-hand sides of the panel. In the illustrated embodiment, the left side marginal edge region 21 is defined by a flange that is an extension of the mortar 14, which proceeds in serpentine fashion about the first bricks 12 of each row 12*a*-12*f*. The right side marginal edge region 20 is defined by a vertically oriented, elongated flange 24 supported in spaced relation below the protruding bricks 12 of the alternative rows 12*b*, 12*d*, 12*f*.

Figure 4:
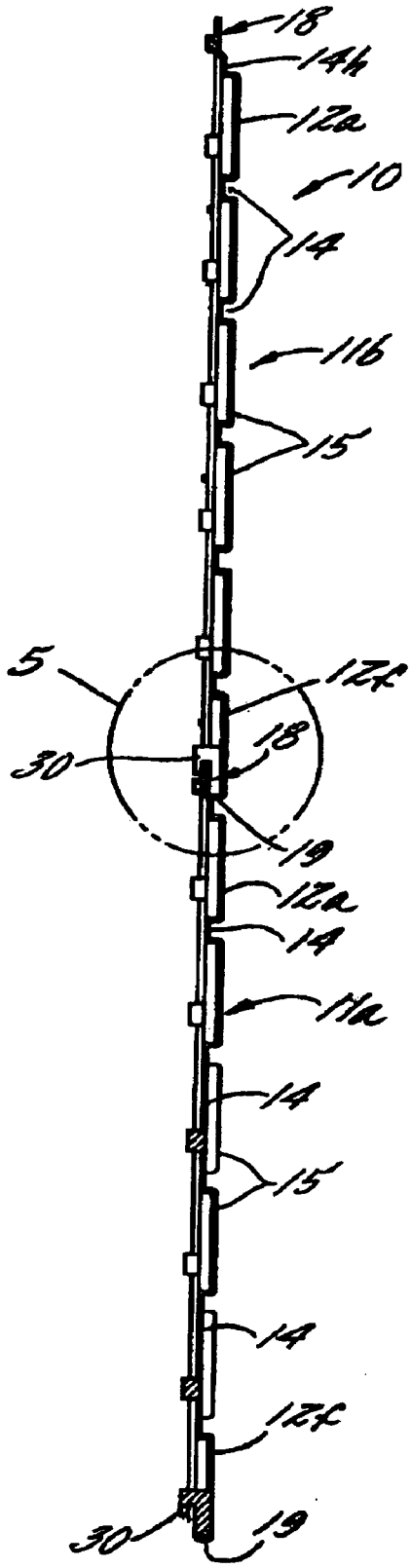
FIG. 4 is a vertical section of the illustrated wall covering, taken in the plane of line 4-4 in FIG. 1.

The panels 11 typically are mounted beginning with the left-hand panel of the lowermost course to be installed on the wall or roof, as is known in the art. Upon completion of the first course, the second course is installed, immediately above the first course, again starting from the left-hand side. As also is known in the art, the left-hand marginal edge region of the first panel of each row is cut square with the left side starting edge of the support surface. In the following description, when discussing the interaction of panels disposed in vertically displaced courses, the upper panel will be designated with the reference "11*b*" and lower or previously mounted panel will be designated with the reference "11*a*" (FIG. 4). This convention is employed in order to clarify the relative positions and order of installation of the subject panels. It will be understood, of course, that despite this nomenclature, the individual panels are substantially identical, and the distinguishing nomenclature is used only to designate positional, not structural, differences.

For securing the panels 11 to the support surface 22, the upper marginal edge region 18 of each panel 11 has a mounting flange 31 parallel to the support surface 22 upon which the panel is mounted formed with a row of elongated laterally spaced nailing apertures 25. In order to provide firm support for the mounting flange 31 on the wall during nailing and for establishing a seal between the rear side of the panel 11 and the support surface 22, the upper marginal edge region 18 in this instance is formed with a pair of rearwardly extending horizontal sealing flanges 26 which extend substantially the length of the upper marginal edge region 18 on top and bottom sides of the nailing apertures 25 (FIG. 3).

Figures 8, 9, 10:
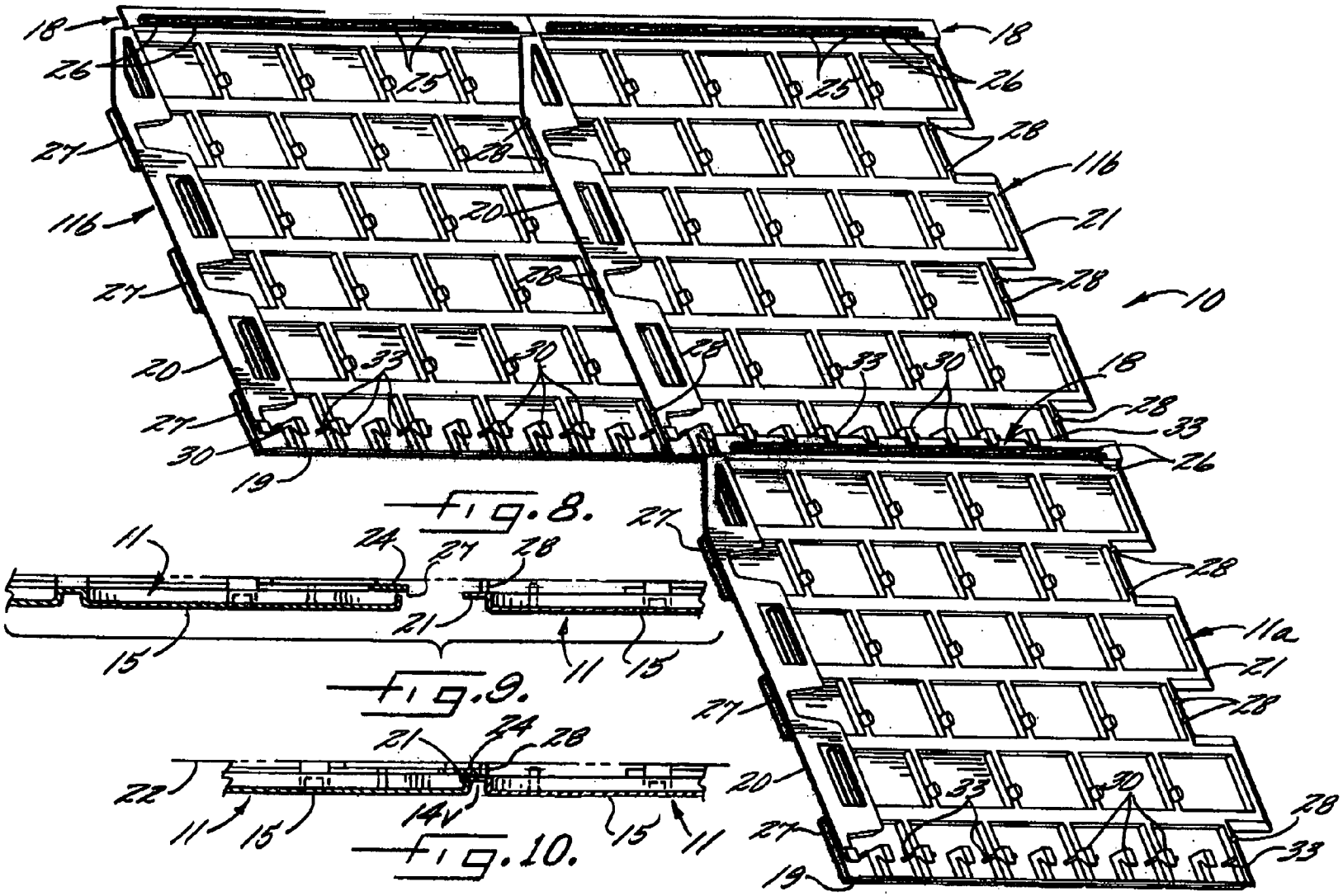
FIG. 8 is a perspective of an underside of the illustrated wall covering.
FIG. 9 is a fragmentary section of adjacent panels in the same row or course prior to side-by-side inter-engaging mounting with each other, taken in the plane of line 9-9 in FIG. 1.
FIG. 10 is a fragmentary section, similar to FIG. 9, showing the panels in mounted inter-engaging relation with each other.

For mounting the next panel 11 in the course, the left side marginal edge region 21 of the panel, defined by the serpentine configured flange, is positioned into mounting slots 27 (FIG. 9) defined between the right side marginal edge region flange 24 and the underside of the last bricks 12 of each row. To facilitate predetermined side positioning of the panel 11 into proper interlocking relation with the previously mounted panel, locator pins 28 are provided on the underside of the left marginal edge regions 21 of each panel which abut the right side marginal edge region panel 24. When properly positioned, the upper marginal edge region 18 is nailed to the mounting surface as described above.

Figure 5:
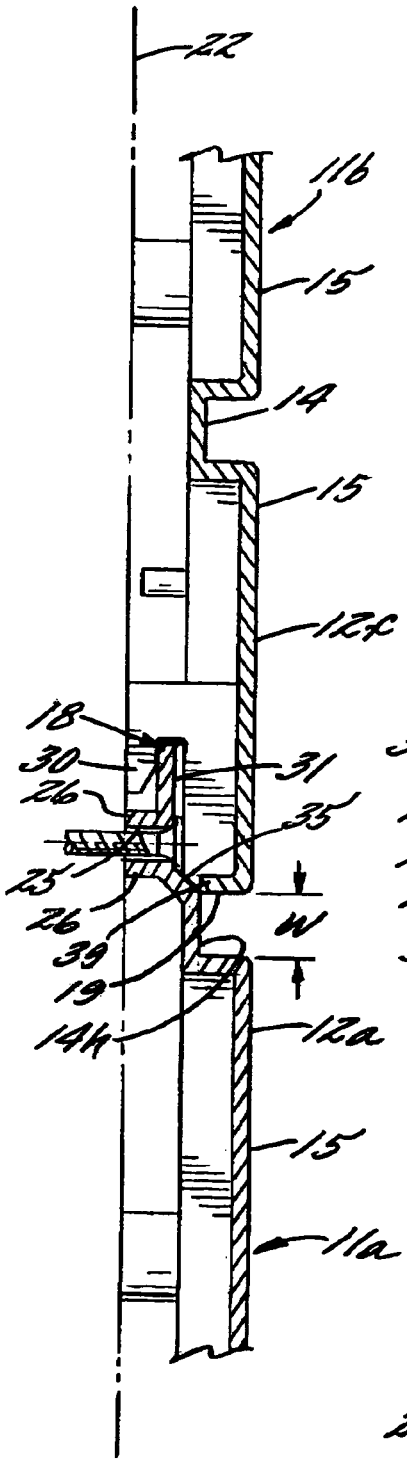
FIG. 5 is an enlarged fragmentary section of the junction between the partially overlapping panels, taken in the encircled area of FIG. 4.
Figure 5A:
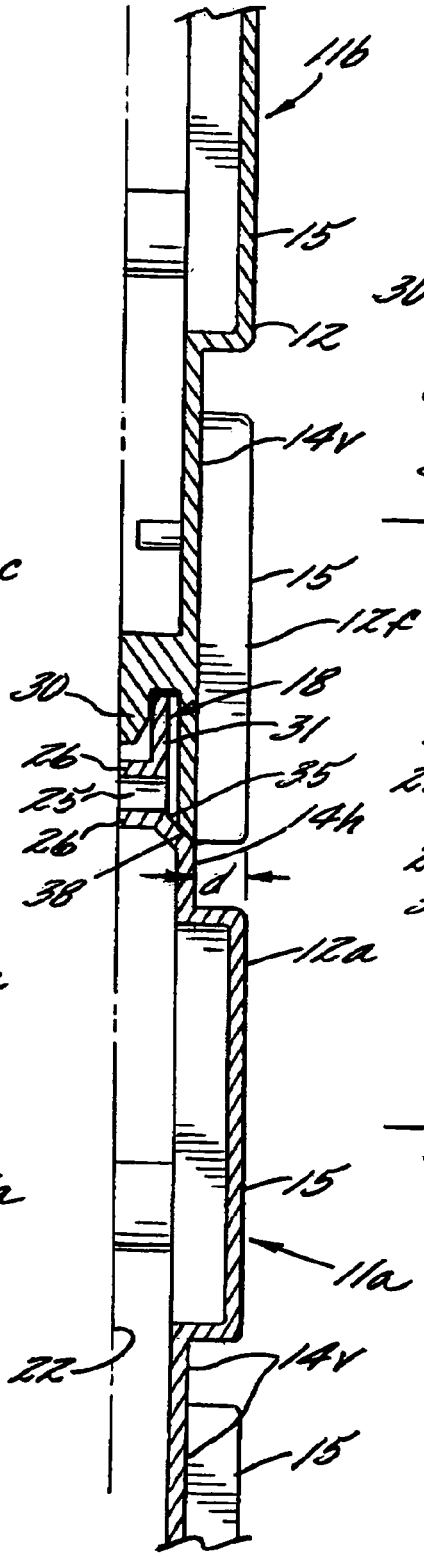
FIG. 5A is an enlarged fragmentary section, taken in the plane of line 5A-5A in FIG. 1, depicting the junction between mortar line of adjacent top and bottom panels.
Figure 6:
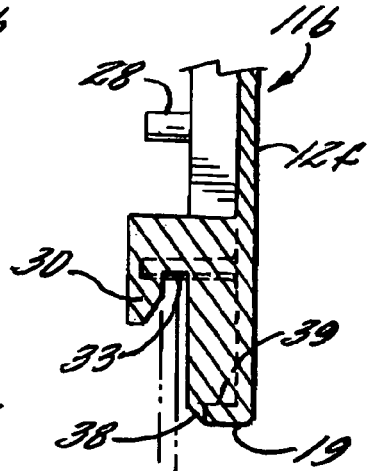
FIGS. 6 and 7 is a depiction of the installation of the panel of an upper row onto the upper marginal edge region of a lower previously installed panel of a lower row.
Figure 7:
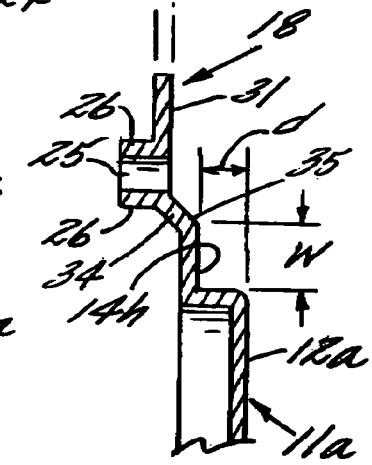

In order to positively interlock the overlapping lower marginal edge region 19 of a panel 11*b* with an upper marginal edge region 18 of a previously mounted panel 11*a* when installing the next course of panels, each panel 11 is formed with a plurality of laterally spaced rearwardly and downwardly directed interlock flanges 30 on the underside of the lower marginal edge region 19 of the panel 11 (FIGS. 5-7), which are engageable with the upper marginal edge region mounting flange 31 of the previously mounted panel 11 a supported in elevated parallel relation to the wall surface 22 by the horizontal sealing flanges 26. For locating the upper panel 11*b* in predetermined overlying relation to the previously mounted panel 11*a* while permitting thermal expansion and contraction of the panels in a vertical direction, frangible locating pins 33 extend rearwardly from the lower marginal edge region 19 which are positionable into abutting relation to the upper perimeter of the upper marginal edge region mounting flange 31.

In accordance with the invention, the mortar lines of adjacent top and bottom panels adjoin each other in coplanar closely adjacent relation such that the simulated brick of each row of the panels has a substantially uniform depth for a more natural and aesthetic appearance. To this end, in the illustrated embodiment, the mounting flange 31 of the upper marginal edge region 18 is disposed in recessed relation to the plane of the mortar lines 14, being supported by a tapered wall 34 that extends inwardly and upwardly have a horizontal mortar line 14*h* adjacent the top row 12*a* of brick 12 and the mounting flange 31. The tapered wall 34 in this case extends at an angle of about 45° to the vertical and has an exposed surface that defines an angled seating surface 35 for the lower marginal edge region 19 of the overlying panel 11*b*. The mortar line 14*h* adjacent the top row 12*a* of simulated brick 12 has a width "w" corresponding with the width of the mortar lines 14 separating the other bricks of the panel, with the upper peripheral edge thereof being defined by the line of intersection of the angled planes of the seating surface 35 and mortar line 14*h*.

In carrying out the invention, the lower marginal edge region 19 of the overlying panel 11*b* is formed with a tapered seating surface 38 (FIG. 7) adapted for mating engagement with the tapered seating surface 35 of the upper marginal edge region 18 of the underlying panel 11*a*. The lower marginal edge region 19 in this case is defined by the lower edge of the overlying panel, which in turn is defined by the depending sides 39 of the bricks 12 of the bottom row 12*f* of the panel and vertical mortar lines 14*v* between the brick 12 and bottom row 12*f*. The tapered seating surface 38 of the lower marginal edge region 19 intersects the sides 39 of the brick 12 and the upper surfaces of the vertical mortar lines 14*v* in a straight line at the base of the brick 12 with the mortar lines 14*h* such that the distance "d" between the line of intersection and outer exposed faces of the brick corresponds to the depth "d" of the other brick of the panel.

In further keeping with the invention, as an incident to mounting of the upper panel 11*b* into interlocking relation with the upper marginal edge region 18 of the previously mounted panel 11*a*, the tapered seating surface 38 of the lower marginal edge region 19 is positioned into adjacent seated relation with the tapered seating surface 35 of the underlying upper marginal edge region 18. The interlock flanges 30 and frangible pins 33 of the lower marginal edge region 19 are designed to guide the seating surface 38 of the upper panel 11*b*, into seating relation with the tapered seating surface 35 of the underlying panel 11*a*, with the vertical mortar lines 14*v* of the overlying panel 11*b* in adjacent parallel relation to the upper horizontal mortar line 14*h* of the underlying panel 11*a*. Such positioning automatically locates the mortar lines 14*v* of the upper panel in adjacent coplanar relation with the upper mortar line 14*h* of the underlying panel with no more than a very fine, and substantially unnoticeable line, separating the brick and mortar design of the mating panels. Moreover, since the mortar lines 14*v* and 14*h* of the top and bottom panels 11*b* , 11*a* are coplanar, the simulated brick 12 of both panels extend substantially the same depth "d" from the mortar, consistent with conventional hand-laid brick walls. Hence, both the mortar lines 14*v* and 14*h* of adjacent panels 11*b*, 11*a* and the outer exposed faces of the protruding brick 12 are disposed in respective common planes, which contributes to the natural and aesthetic appearance of the wall. Since the bricks 12 all protrude a uniform distance from the mortar lines 14, there is no noticeable line of demarcation between the panels, nor possibility for excessive shadowing at the line of juncture, such as in the prior art. Moreover, since the seating surfaces 35, 38 are tapered, the lower marginal edge region 19 of the overlying panel 11*b* can move slightly along the underlying tapered seating surface 35 due to temperature expansion and contraction of the panels, without materially detracting from the aesthetic appearance of the junction.

From the foregoing, it can be seen that a wall covering is provided that comprises panels formed with a simulated hand-laid brick and mortar design adapted for installation on a wall with a more aesthetic and natural appearance. Both the exposed faces of the simulated brick and the mortar lines adjacent the brick are in substantially coplanar relation with each other, typical of hand-laid brick and mortar walls. The junction between mating panels is substantially unnoticeable and the uniformity of the brick and mortar design does not incur shadowing between panels, typical of the prior art. The panels, furthermore, lend themselves to efficient installation and permit temperature expansion and contraction without materially detracting from the aesthetic appearance of the wall covering.

What is claimed is:

1. A wall covering for mounting on a support surface comprising a plurality of panels each having upper and lower marginal edge regions;

said panels being mountable on said support surface in a plurality of horizontal courses with said panels in a first horizontal course having an upper marginal edge region underlying a lower marginal edge region of said panels in a second horizontal course positioned above the first horizontal course; said panels each being formed with a simulated brick and mortar design comprising horizontal rows of brick protruding from horizontal and vertical lines of mortar separating the brick, said brick and mortar lines having outer exposed faces, said upper marginal edge region of each panel being formed with a first tapered seating surface disposed at an acute angle to the plane of said mortar lines and exposed faces of said brick, said first tapered seating surface intersecting the exposed faces of some of said mortar lines, and the lower marginal edge region of each panel being formed with a second tapered seating surface at an angle to the plane of said mortar lines and exposed faces of said brick similar to the first tapered seating surface of said upper marginal edge region, said second tapered seating surface intersecting the exposed faces of some of said mortar lines for mounted positioning in overlying relation to the first tapered seating surface of the upper marginal edge region of an underlying panel as viewed in a direction toward the support surface with mortar lines of the underlying panel in adjacent substantially coplanar relation with mortar lines of the overlying panel while permitting relative movement of the lower marginal edge region of the overlying panel with respect to the upper marginal edge region of the underlying panel as an incident to temperature expansion and contraction of the panels.

2. The wall covering of claim 1 in which said simulated brick of said panels protrude substantially equal distances from said mortar lines.

3. The wall covering of claim 1 in which said mortar lines of said panels are in a substantially common plane, and said simulated brick of said panels have outer exposed faces in a substantially common plane outwardly of the plane of said mortar lines.

4. The wall covering of claim 1 in which the upper marginal edge region of each panel includes a mounting flange for securing the panel on a support surface, and said mounting flange being disposed in recessed relation to the plane of said mortar lines.

5. The wall covering of claim 1 in which said tapered seating surfaces are disposed at an angle of about 45° to the planes of said mortar lines and outer exposed faces of said brick.

6. The wall covering of claim 1 in which said upper marginal edge region of each panel including a mounting flange parallel to the plane of said mortar lines and exposed faces of said brick for securement to a support surface, a tapered wall extending upwardly and inwardly between the brick and mortar design of the panel and the mounting flange at an acute angle to the plane of the mortar lines and the exposed surfaces of said brick for supporting the mounting flange in recessed relation to the plane of said mortar lines, said upper marginal edge region tapered wall forming a tapered seating surface, and said lower marginal edge region of each panel being formed with a tapered seating surface at an angle to the mortar lines and exposed brick faces similar to that of the seating surface of the upper marginal edge region for positioning in mounted adjacent relation to the seating surface of the upper marginal edge region.

7. The wall covering of claim 1 in which said panels are formed with a horizontal mortar line adjacent a top side of an uppermost row of brick of the panel, and said tapered seating surface of said upper marginal edge region defining an upper peripheral edge of said horizontal mortar line.

8. The wall covering of claim 7 in which said lower marginal edge region of each panel is defined by a lowermost row of said bricks and vertical mortar line separating the bricks of said lowermost row, and said tapered seating surface of said lower marginal edge region intersects said lowermost row of bricks and said vertical mortar lines in a straight line through a lower perimeter of said vertical mortar lines and a lower perimeter of the bricks protruding from the vertical mortar lines.

9. The wall covering of claim 1 in which a lower marginal edge region of each panel is formed with a rearwardly extending and depending flange for engaging the upper marginal edge region of an underlying panel for interlocking the lower and upper marginal edge regions and for positioning the tapered seating surfaces of overlying marginal edge regions in aligned seating relation.

10. The wall covering of claim 1 in which one of said seating surfaces intersects a horizontal side of a row of said brick, and the other of said seating surfaces intersects a horizontal side of a horizontal mortar line.

11. A wall covering for mounting on a support surface comprising a plurality of panels each having upper and lower marginal edge regions;

said panels being mountable on said support surface in a plurality of horizontal courses with said panels in a first horizontal course having an upper marginal edge region underlying a lower marginal edge region of said panels in a second horizontal course positioned above the first horizontal course; said panels each being formed with a simulated brick and mortar design comprising horizontal rows of brick protruding from horizontal and vertical lines of mortar separating the brick, said brick and mortar lines having outer exposed faces, said upper marginal edge region of each panel being formed with a first tapered seating surface disposed at an acute angle to the plane of said mortar lines and exposed faces of said brick, said first tapered seating surface intersecting the exposed faces of some of said mortar lines, and the lower marginal edge region of each panel being formed with a second tapered seating surface at an angle to the plane of said mortar lines and exposed faces of said brick similar to the first tapered seating surface of said upper marginal edge region, said second tapered seating surface intersecting the exposed faces of some of said mortar lines for mounted positioning against the first tapered seating surface of the upper marginal edge region of an underlying panel with mortar lines of the underlying panel in adjacent substantially coplanar relation with mortar lines of the overlying panel, and said second tapered seating surface intersecting a lower most perimeter of the lower most row of brick while permitting relative movement of the lower marginal edge region of the overlying panel with respect to the upper marginal edge region of the underlying panel as an incident to temperature expansion and contraction of the panels.

12. A wall covering for mounting on a support surface comprising a plurality of panels each having upper and lower marginal edge regions;

said panels being mountable on said support surface in a plurality of horizontal courses with said panels in a first horizontal course having an upper marginal edge region underlying a lower marginal edge region of said panels in a second horizontal course positioned above the first horizontal course; said panels each being formed with a simulated brick and mortar design comprising horizontal rows of brick protruding from horizontal and vertical lines of mortar separating the brick, said brick and mortar lines having outer exposed faces, said upper marginal edge region of each panel being formed with a first tapered seating surface disposed at an acute angle to the plane of said mortar lines and exposed faces of said brick, said first tapered seating surface intersecting the exposed faces of some of said mortar lines, and the lower marginal edge region of each panel being formed with a second tapered seating surface at an angle to the plane of said mortar lines and exposed faces of said brick similar to the first tapered seating surface of said upper marginal edge region, said second tapered seating surface intersecting the exposed faces of some of said mortar lines for mounted positioning against the first tapered seating surface of the upper marginal edge region of an underlying panel with mortar lines of the underlying panel in adjacent substantially coplanar relation with mortar lines of the overlying panel, said upper marginal edge region of each panel including a mounting flange parallel to the plane of said mortar lines and exposed faces of said brick for securement to a support surface, and said first tapered seating surface being disposed below said mounting flange and above an upper most row of said brick for permitting relative movement of the lower marginal edge region of the overlying panel with respect to the upper marginal edge region of the underlying panel as an incident to temperature expansion and contraction of the panels.

* * * * *